United States Patent [19]

Pinck et al.

[11] Patent Number: 4,878,506

[45] Date of Patent: Nov. 7, 1989

[54] METHOD OF AND APPARATUS FOR TREATING ACCUMULATIONS OF FIBERS OF TOBACCO OR OTHER SMOKABLE MATERIAL

[75] Inventors: Peter Pinck, Gross-Hansdorf; Heinz-Christen Lorenzen, Wentorf; Uwe Heitmann; Wolfgang Siems, both of Hamburg, all of Fed. Rep. of Germany

[73] Assignee: Körber AG, Hamburg, Fed. Rep. of Germany

[21] Appl. No.: 225,692

[22] Filed: Jul. 28, 1988

[30] Foreign Application Priority Data

Jul. 31, 1987 [DE] Fed. Rep. of Germany ..... 3725364

[51] Int. Cl.[4] ..... A24C 5/18; A24C 5/28; A24C 5/34

[52] U.S. Cl. ..... 131/84.4; 131/84.3; 131/905; 131/906

[58] Field of Search ..... 131/84.4, 906, 84.1, 131/84.3

[56] References Cited

U.S. PATENT DOCUMENTS 4,759,379 7/1988 Lorenzen ..... 131/84.1 X
4,799,501 1/1989 Liebe et al. ..... 131/311 X

FOREIGN PATENT DOCUMENTS 2126072 3/1984 United Kingdom ..... 131/84.4
2133965 8/1984 United Kingdom .
2179444 3/1987 United Kingdom .
2182836 5/1987 United Kingdom .
2191931 12/1987 United Kingdom ..... 131/84.4

*Primary Examiner*—Vincent Millin
*Assistant Examiner*—D. F. Crosby
*Attorney, Agent, or Firm*—Peter K. Kontler

[57] ABSTRACT

The tobacco stream which is formed at the underside of a foraminous conveyor and carries a surplus of tobacco particles is transported past a trimming device which removes the surplus to convert the stream into a filler which is thereupon wrapped into a web of cigarette paper. The mass flow of tobacco particles in the untrimmed stream is monitored by a detector which utilizes infrared light, and the signals from such detector are used to change the position of the conveyor relative to the trimming device so as to ensure that the mass flow of tobacco particles in the filler remains within a desired range. One or more additional detectors monitor the mass of flow tobacco particles in the filler upstream and/or downstream of the wrapping station, and the signals from such second detector or detectors are used to correct the position of the conveyor relative to the trimming device and/or to change the position of the trimming device relative to the conveyor.

45 Claims, 3 Drawing Sheets

METHOD OF AND APPARATUS FOR TREATING ACCUMULATIONS OF FIBERS OF TOBACCO OR OTHER SMOKABLE-MATERIAL

CROSS-REFERENCE TO RELATED CASES

The method and apparatus of the present invention are related to those disclosed in our commonly owned copending patent applications Ser. Nos. 225,693 and 225,694 filed on even date for "Apparatus for measuring the density of a tobacco stream" and "Method of and apparatus for making a trimmed stream of tobacco fibers or the like".

BACKGROUND OF THE INVENTION

The invention relates to the treatment of fibers of tobacco or other smokable materials, and more particularly to improvements in methods of and in apparatus for treating accumulations of such fibers. Still more particularly, the invention relates to improvements in methods of and in apparatus for regulating the mass flow of fibers in streams of fibers of tobacco or other smokable materials.

As used herein, the term "fibers" is intended to denote fibers of natural tobacco, reconstituted tobacco, artificial tobacco and filter material for tobacco smoke.

A machine for making a tobacco rod or a filter rod normally comprises a conveyor which defines for the fibrous material an elongated path and receives fibrous material from a duct or another suitable supplying device in such quantities that it builds up a stream with a surplus of fibrous material. The stream is attracted to the conveyor by suction, and the surplus is removed by a suitable trimming or equalizing device so that the trimmed stream constitutes a filler which is ready to be draped into a web of cigarette paper or other suitable wrapping material, the draped filler and the wrapping material together forming a continuous rod which is thereupon subdivided into rod-shaped smokers' products or filter rod sections of unit length or multiple unit length.

The density of the stream on the conveyor can be monitored upstream of the trimming station and the position of the trimming device relative to the conveyor is adjusted if the monitored density deviates from a desired or optimum density. Such regulation is intended to eliminate or to counteract short-range deviations of the characteristics of the untrimmed stream from a optimum value.

OBJECTS OF THE INVENTION

An object of the invention is to provide a novel and improved method of influencing the making of rods of tobacco or filter material in such a way that the characteristics of the filler in the rod closely approximate or match the optimum value.

Another object of the invention is to provide is to provide a method which renders it possible to immediately interfere with the processing of fibers in response to detection of deviations of actual characteristics of the product from the desired characteristics.

A further object of the invention is to provide novel and improved means for regulating the trimming of a stream of fibrous material which carries a surplus while being attracted to a foraminous conveyor.

An additional object of the invention is to provide a method which renders it possible to take into consideration all parameters that are likely to influence the quality of the filler in a tobacco rod or filter rod.

Still another object of the invention is to provide a method which renders it possible to ensure that each and every increment of the filler in a rod of tobacco or filter material contains the desired quantity of fibrous material.

A further object of the invention is to provide an apparatus which can be used for the practice of the above outlined method and wherein the position of the trimming device need not be changed in order to change the quantity of fibrous material in the filler of a tobacco rod or filter rod.

An additional object of the invention is to provide a rod making machine which embodies the above outlined apparatus.

A further object of the invention is to provide the apparatus with novel and improved means for processing signals which denote the mass flow of fibers in a stream of fibrous material.

Another object of the invention is to provide the apparatus with novel and improved means for mounting the conveyor which advances a stream of fibrous material toward, past and beyond the surplus removing station.

SUMMARY OF THE INVENTION

One feature of the present invention resides in the provision of a method of treating accumulations of fibers of tobacco, other smokable material or filter material for tobacco smoke. The method comprises the steps of establishing for the fibers an elongated path, supplying fibers into a first portion of the path in such quantities that the fibers form a stream which contains a surplus of fibers, advancing the stream along the path in a predetermined direction by a foraminous conveyor including attracting the fibers to the conveyor by suction, removing the surplus from the stream in a second portion of the path downstream of the first portion to thus convert the stream into a filler including trimming the stream in a plane which is spaced apart from the conveyor, monitoring the mass flow of fibers in the path upstream of the second portion of the path and generating a succession of signals which denote the mass flow of fibers in successive increments of the stream, and moving the conveyor relative to the plane in response to the signals so as to maintain the mass flow of fibers in the filler within a predetermined range. The moving step preferably includes moving the conveyor nearer to the plane when the mass flow exceeds the predetermined range, and moving the conveyor away from the plane when the mass flow is beneath the predetermined range.

The monitoring step can include directing against the stream at least one beam of radiation a portion of which penetrates through the stream and is indicative of the mass flow of fibers in the respective increments of the stream. The signals are indicative of that radiation which penetrates through the stream. The radiation can consist of infrared light, X-rays or beta rays.

The monitoring step preferably includes monitoring the mass flow of those fibers which are disposed between the conveyor and the plane.

The method preferably further comprises the step of monitoring the mass flow of fibers in successive increments of the filler in a third portion of the path downstream of the second portion and generating a succession of second signals which denote such mass flow of fibers in the filler. This method further comprises the step of draping the filler into a web of wrapping material in a fourth portion of the path which is located upstream or downstream of the third portion. The step of monitoring the mass flow of fibers in successive increments of the filler upstream or downstream of the location where the filler is draped into a web of wrapping material can include directing against the filler at least one beam of light (particularly infrared light) whereby some of the light penetrates through the filler. The second signals are indicative of light which has penetrated through the filler. Alternatively, the second monitoring step can include directing against the filler at least one beam of X-rays or beta rays whereby some of the rays penetrate through the filler and the second signals are indicative of those rays which have penetrated through the filler.

Signals which are indicative of a mass flow of fibers in successive increments of the stream can be modified or corrected by signals which are generated to indicate the mass flow of fibers in successive increments of the filler. This is particularly desirable and advantageous if the step of monitoring the mass flow of fibers in the stream is carried out with infrared light and the step of monitoring the mass flow of fibers in the filler is carried out with beta rays or X-rays.

The method can further comprise the step of varying the mutual spacing of the conveyor and the plane as a function of the characteristics of second signals (i.e., signals which denote the mass flow of fibers in successive increments of the filler) so as to maintain the mass flow of fibers in the filler at a preselected average value. Such varying step can include moving the conveyor relative to the plane and/or vice versa.

Another feature of the invention resides in the provision of an apparatus for treating accumulations of fibers of tobacco, other smokable material or filter material for tobacco smoke. The apparatus comprises guide means including a foraminous conveyor which defines an elongated path, means for supplying fibers into a first portion of the path in such quantities that the fibers form a stream which contains a surplus of fibers, means for pneumatically attracting the fibers to the conveyor so that the stream advances with the conveyor along the path in a predetermined direction, means for removing the surplus from the stream in a second portion of the path downstream of the first portion (to thus convert the stream into a filler) including means for trimming the stream in a plane which is spaced apart from the conveyor, means for monitoring the mass flow of fibers in the path upstream of the second portion of the path including means for generating a succession of signals which denote the mass flow of fibers in successive increments of the stream, and means for moving at least a portion of the conveyor relative to the plane in response to the signals so as to maintain the mass flow of fibers in the filler within a predetermined range.

The monitoring means preferably further comprises at least one source of radiation which directs against the stream at least one beam of radiation a portion of which penetrates through the stream and is indicative of the mass flow of fibers in successive increments of the stream. The signal generating means of such monitoring means includes at least one receiver (such as a photoelectronic transducer) of radiation which penetrates through the stream. The at least one source can admit light, preferably infrared light, X-rays or beta rays.

The guide means preferably further includes an elongated channel having sidewalls and a bottom wall which is preferably constituted by the foraminous conveyor. The monitoring means is preferably designed to monitor the mass flow of fibers in the channel between the conveyor and the plane of the trimming means. The conveyor preferably constitutes or includes an endless foraminous belt conveyor.

The apparatus preferably further comprises second monitoring means for monitoring the mass flow of fibers in the path downstream of he second portion of the path. Such second monitoring means includes means for generating second signals which denote the mass flow of fibers in successive increments of the filler. The apparatus further comprises means for draping the filler into a web of wrapping material upstream or downstream of the second monitoring means.

The second monitoring means preferably further includes at least one source of radiation which serves to direct against the filler at least one beam of radiation a portion of which penetrates through the filler and is indicative of the mass flow of fibers in the respective increments of the filler. The means for generating second signals then includes at least one receiver (such as a photoelectronic transducer) of radiation which penetrates through the filler. The radiation source of the second monitoring means can be designed to emit light, especially infrared light, X-rays or beta rays.

The apparatus preferably further comprises means for modifying the signals from the means for monitoring the mass flow of fibers in successive increments of the stream. Such modifying of signals is particularly desirable if the monitoring means for the mass flow of fibers in the stream includes at least one light source, especially a source of infrared light, because infrared radiation can be influenced by certain variable parameters of the fibers, such as the blend and/or the color of fibers.

The apparatus can also comprise means for varying the distance between the conveyor and the plane of the trimming means in response to the second signal so as to maintain the mass flow of fibers in the filler at least close to a predetermined value. Such a varying means can include means for moving the trimming means nearer to or away from the conveyor and/or vice versa. The means for changing the position of the conveyor relative to the plane of the trimming means can include a stepping motor, and the varying means of such apparatus can further comprise means for modifying signals which denote the mass flow of fibers in successive increments of the stream by the second signals, and means for applying the modified signals to the motor to influence the changes of position of the conveyor relative to the plane of the trimming means. Such varying means can further comprise means for comparing the second signals with a reference signal which denotes a desired mass flow of fibers in the filler and for generating additional signals which denote the difference between the second signals and the reference signal. The applying means is then operative to regulate the operation of the stepping motor in response to such additional signals.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
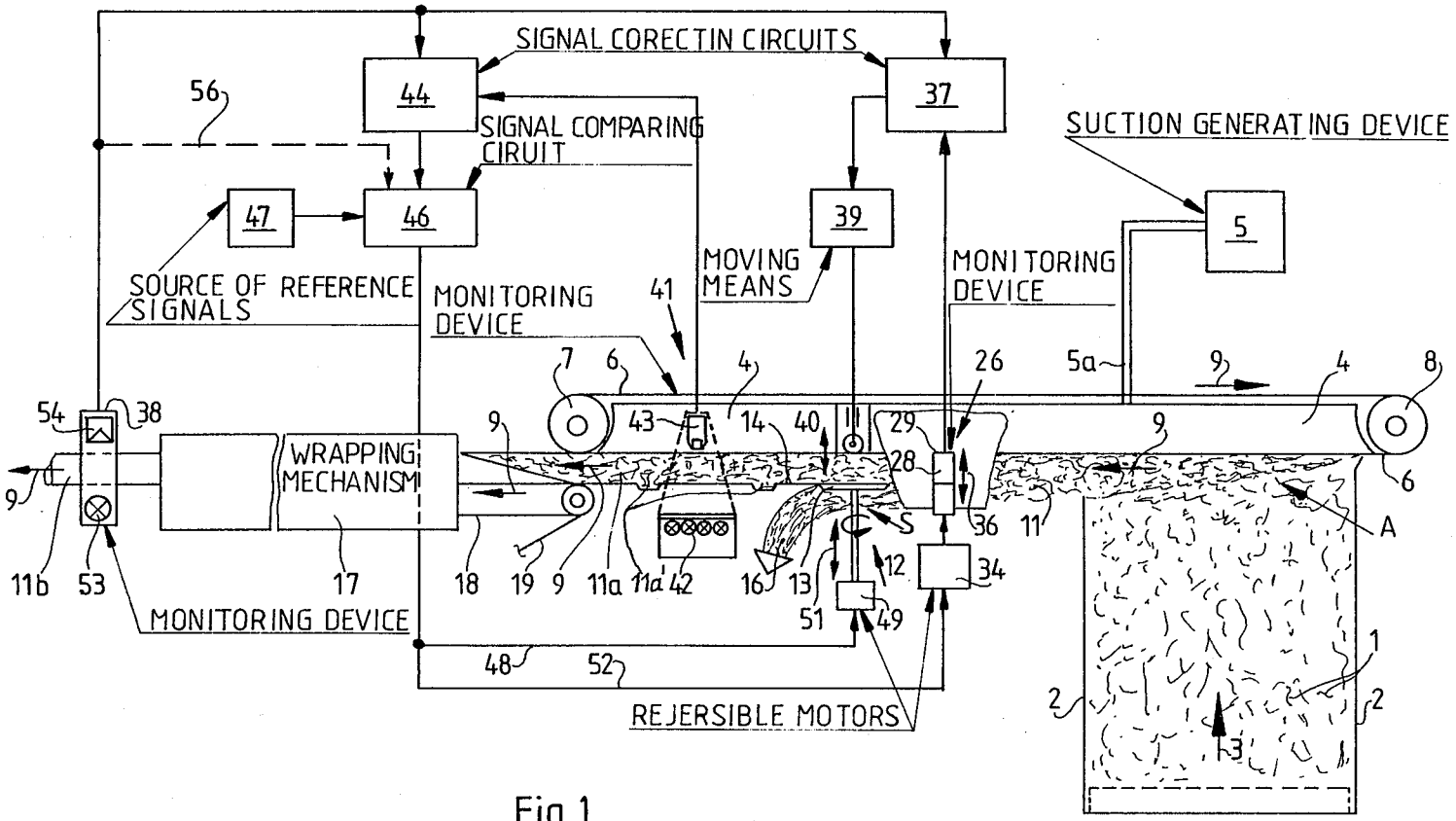
FIG. 1 is a fragmentary schematic partly elevational and partly vertical sectional view of a cigarette rod making machine including an apparatus which embodies one form of the invention and serves to alter the trimming or equalizing action in dependency upon signals which are indicative of the mass flow of fibers in the untrimmed and trimmed stream of tobacco fibers, the apparatus of FIG. 1 being designed to move the conveyor for the stream of tobacco fibers relative to the trimming plane and vice versa.
Figures 2, 4:
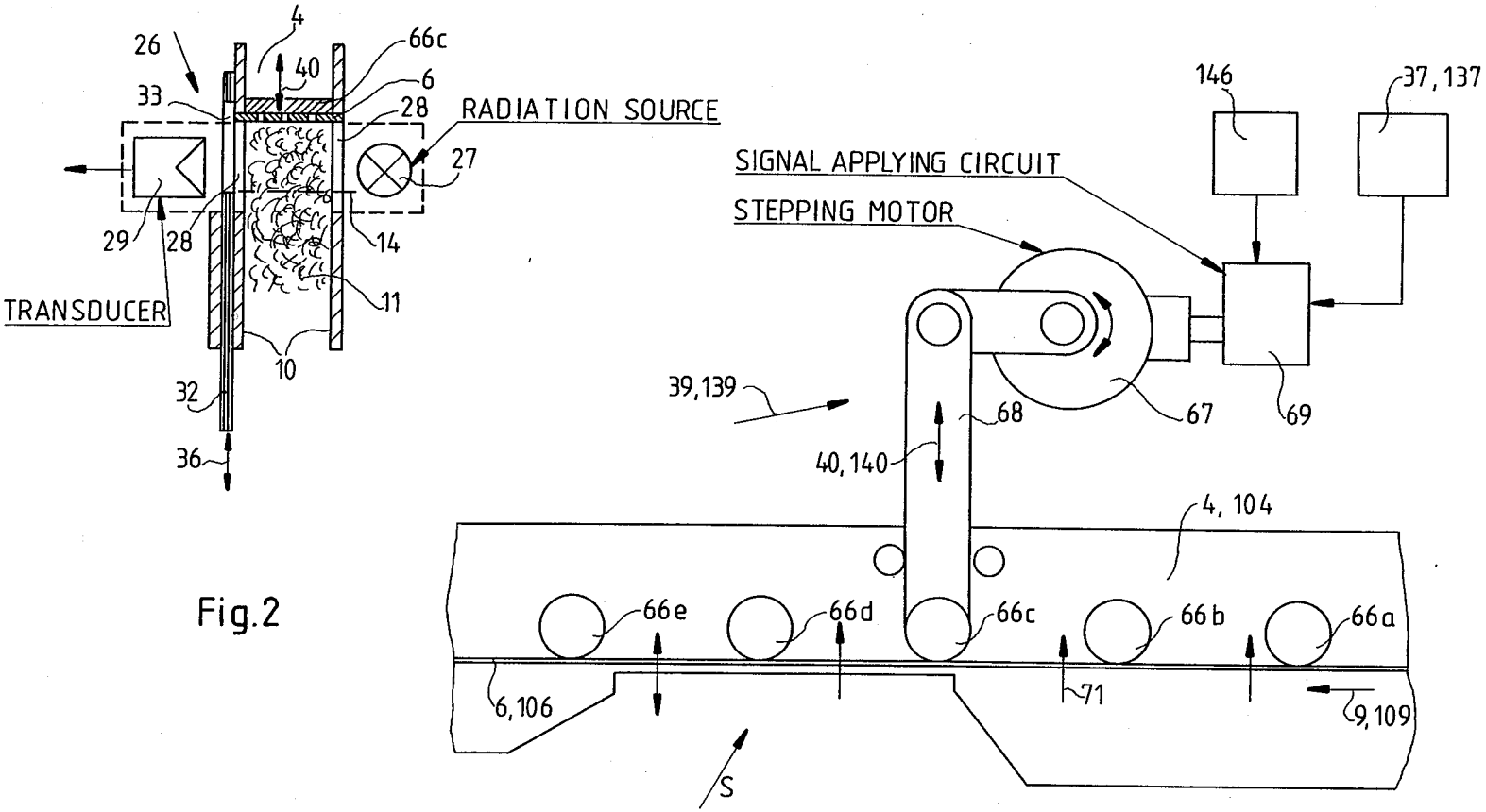
FIG. 2 is an enlarged transverse vertical sectional view of the apparatus, showing the details of one presently preferred means for monitoring the mass flow of fibers in the untrimmed stream of fibrous material.
FIG. 4 is an enlarged view of certain details of presently preferred means for moving the conveyor relative to the trimming device.

Referring first to FIG. 1, there is shown a portion of a cigarette rod making machine wherein tobacco fibers 1 are supplied in the form of a rising shower in an upright duct 2 in the direction which is indicated by an arrow 3. The fibers 1 impinge upon the underside of the lower reach of an elongated foraminous endless belt conveyor 6 which is trained over pulleys 7 and 8 so that it advances in the direction indicated by arrows 9. One of the pulleys 7, 8 is driven in a clockwise direction, preferably at a variable speed. The means for attracting the fibers 1 which reach the underside of the lower reach of the conveyor 6 comprises a suction chamber 4 which is disposed above the lower reach of the conveyor 6, a suction generating device 5 (for example, a suitable fan) and a conduit 5*a* which connects an outlet of the suction chamber 4 with the intake of the suction generating device 5. The station where the rising tobacco fibers 1 are converted into a stream 11 as shown at A. As shown in FIG. 2, the lower reach of the endless foraminous belt conveyor 6 constitutes the bottom wall of a composite guide means constituting a channel with two parallel sidewalls 10 which extend downwardly from the conveyor 6 and flank the fully grown stream 11 downstream of the stream building station A. The underside of the fully grown stream 11 exhibits the customary hills and valleys which are eliminated by trimming the stream in a plane 14 (indicated in FIG. 2 by a horizontal phantom line). The surplus removing means 12 includes two trimming discs 13 which cooperate in the plane 14 to remove the surplus 16 and to provide the underside of the resulting filler 11*a* with a smooth surface or with longitudinally spaced apart projections 11*a*' which are necessary when the machine is to produce cigarettes with so-called dense ends. If the machine is to produce cigarettes with dense ends, the marginal portions of the discs 13 have circumferentially spaced apart recesses for fibers 1 which are to form the projections 11*a*'. The marginal portions of the discs 13 clamp the stream 11 in the plane 14, and a brush, a paddle wheel or another removing tool (not shown) separates from the filler 11*a* those fibers 1 which are located below the plane 14, i.e., which constitute the surplus 16. The surplus 16 is returned into the distributor (also called hopper) which delivers fibers into the duct 2. The aforementioned brush or paddle wheel of the surplus removing means 12 is rotatable about a horizontal axis beneath the plane 14 so that it can sweep away all tobacco fibers 1 which extend downwardly beyond such plane. Surplus removing means 12 of the type shown in FIG. 1 are well known in the art. For example, the machine of FIG. 1 can employ surplus removing means of the type used in cigarette rod making machines known as PROTOS which are manufactured by the assignee of the present application.

The filler 11*a* is advanced toward and into a draping or wrapping mechanism 17 which is located downstream of the surplus removing or equalizing station S. A belt conveyor 18, known as garniture, delivers into the wrapping mechanism 17 a continuous web 19 of cigarette paper or other suitable wrapping material together with the filler 11*a*. The mechanism 17 converts the filler 11*a* and the web 19 into a continuous cigarette rod 11*b* which is thereupon subdivided into plain cigarettes of unit length or multiple unit length. Such cigarettes can be delivered directly to a packing machine, to storage or to a filter tipping machine. The manner in which one marginal portion of the web 19 is coated with adhesive so that it can be bonded to the other marginal portion during conversion of successive increments of the web 19 into a tube which surrounds the condensed filler 11*a* in the wrapping mechanism 17 is well known in the art and need not be described here.

The improved apparatus serves to adjust the mass flow of fibers 1 in the filler 11*a* and comprises a monitoring device 26 which is located downstream of the stream building station A but upstream of the surplus removing station S.

The details of one presently preferred embodiment of the monitoring device 26 are shown in FIG. 2. It comprises at least one radiation source 27 which is located at one side of the path of movement of the stream 11 at the underside of the lower reach of the conveyor 6, and a receiver 29 which is disposed at the other side of the stream opposite the radiation source 27. The source 27 can emit light, preferably infrared light, which penetrates through a window or opening 28 in the right-hand sidewall 10 of the tobacco channel prior to penetrating into the stream 11. That portion of radiation which penetrates all the way through and issues from the stream 11 is indicative of the mass flow (mass per unit length) of the upper portion of the stream 11, namely of the stream portion between the plane 14 and the lower reach of the conveyor 6. The receiver 29 can constitute a radiation-sensitive semiconductor which converts the impinging radiation into an electric signal denoting the mass flow of fibers 1 in the respective increment of the stream 11. The receiver 29 is outwardly adjacent a window or opening 28 in the left-hand sidewall 10 of the tobacco channel, such window being in exact register with the window 28 in the right-hand sidewall 10. The effective area of the left-hand window 28 in FIG. 2 can be varied in dependency upon the distance between the plane 14 and the lower reach of the conveyor 6 by a vertically reciprocable diaphragm 32 having an aperture 33 in partial or full register with the left-hand window 28, depending upon the position or level of the lower reach of the conveyor 6 and/or upon the level of the plane 14. The directions in which the diaphragm 32 is reciprocable are indicated by a double-headed arrow 36. The arrangement is such that the aperture 33 of the diaphragm 32 permits passage of that portion of radiation which penetrates through the stream 11 at a level above the plane 14 and below the lower reach of the conveyor 6. In other words, the receiver 29 is supposed to receive radiation which is indicative of the mass flow of fibers 1 in those increments of the unequalized or untrimmed stream 11 which are to form successive increments of the filler 11*a*. The diaphragm 32 can constitute a simple plate or panel with a window which constitutes the aperture 33 and is movable along the left-hand sidewall 10 of FIG. 2 in a manner as will be described with reference to FIG. 1. The means for reciprocating the diaphragm 32 comprises a drive 34 which is responsive to signals from a signal comparing circuit 46. The diaphragm 32 shares the upward and downward movements (see the double-headed arrow 40) of the lower reach of the conveyor 6 and is further movable relative to the conveyor 6 in response to signals from the signal comparing circuit 46 to the drive means 34. The latter can constitute a reversible electric motor.

The output of the receiver 29 transmits signals to a signal correcting or modifying circuit 37 which, in turn, transmits corrected signals to a moving means 39, preferably of the type shown in FIG. 4, serving to move a portion of the conveyor 6 up or down (arrow 40) in the region above the trimming discs 13 of the surplus removing means 12. The correcting or modifying circuit 37 modifies signals which are transmitted by the receiver 29 of the monitoring device 26 in accordance with the characteristics of signals from a second monitoring device 38 which is installed downstream of the wrapping mechanism 17 and serves to monitor the mass flow of fibers 1 in successive increments of the condensed filler 11*a* forming part of the cigarette rod 11*b*.

The purpose of the second monitoring means 38 is to transmit signals which are totally unaffected by certain variable parameters of tobacco fibers 1, particularly the blend of tobacco which forms the filler 11*a* of the cigarette rod 11*b* and/or the color of fibers 1. Such parameters could influence the signals which are generated by the receiver 29 of the monitoring device 26 if the radiation source 27 admits infrared light. To this end, the second monitoring device 38 comprises a radiation source 53 which preferably emits beta rays or X-rays. Such radiation is not affected in any way by the blend and/or color of tobacco fibers 1. Signal which are emitted by the correcting or modifying circuit 37 are no longer affected by the blend and/or color of tobacco fibers, and such signals are used at 39 to change the level of the corresponding portion of the lower reach of the conveyor 6 so as to alter the distance between the lower reach of this conveyor and the plane 14 of the trimming discs 13.

Of course, if the monitoring device 26 utilizes one or more radiation sources 27 which emit X-rays or beta rays, the monitoring device 38 can be omitted because the radiation which penetrates through the untrimmed or unequalized stream 11 is then unaffected by the blend and/or color of tobacco fibers 1. A suitable monitoring device which operates with X-rays is disclosed, for example, in published British patent application No. 2 182 836.

An advantage of monitoring devices which operate with infrared light is that they can generate signals denoting the mass flow of fibers in corresponding increments of the moving stream 11 practically instantaneously so that the position or level of the lower reach of the conveyor 6 above the plane 14 of the trimming discs 13 can be altered in immediate response to detection of deviations of mass flow of fibers 1 from the desired or optimum mass flow. The arrangement is such that the moving means 39 lifts the corresponding portion of the lower reach of the conveyor 6 when the mass flow of fibers 1 is unsatisfactory (insufficient quantities of tobacco fibers in successive increments of the filler 11*a*) and that the corresponding portion of the lower reach of the conveyor 6 is lowered to move toward the plane 14 when the quantity of fibers 1 in successive increments of the filler 11*a* is excessive. Presently preferred embodiments of moving means 39 will be described with reference to FIG. 4.

An advantage of the monitoring device 26 and moving means 39 is that they assure a highly satisfactory rapid upward gain control (also called disturbance intrusion) by rapidly reacting to any and all deviations of the mass flow of fibers 1 in the monitored (upper portion of the stream 11 from an optimum value or an optimum range of values. The optimum value is preferably a constant value.

The improved apparatus further comprises an additional or third monitoring device 41 which is located downstream of the surplus removing station S but upstream of the wrapping mechanism 17. The purpose of the device 41 is to monitor the filler 11*a* and to ensure that the mass flow of fibers in successive increments of the filler 11*a* will closely approximate or match a desired average value. The construction of the monitoring device 41 can be similar to that of the monitoring device 26 or 38. It is presently preferred to employ a monitoring device 41 which utilizes a radiation source 42 serving to emit light, especially infrared light. Such source can include a battery of, for example, four light sources which are adjacent each other to form a row extending in the longitudinal direction of the filler 11*a*. Radiation which is emitted by the source 42 penetrates into and in part through the filler 11*a* and impinges upon the signal generating receiver 43 of the monitoring device 41. The receiver 43 converts radiation which has penetrated through the filler 11 into electric signals which are transmitted to one input of a second signal correcting or modifying circuit 44 having a second input connected with the output of the signal generating means 54 of the monitoring means 38. Correction of signals which are transmitted by the receiver or signal generating means 43 of the monitoring device 41 is necessary if the radiation source 42 emits infrared light. As mentioned above, such radiation can be affected by the blend and/or color of tobacco fibers in the filler 11*a* so that the signals which are transmitted by the receiver 43 could be misleading in that they would not properly denote the mass flow of fibers in successive increments of the filler.

As mentioned above, the radiation source 53 of the monitoring device 38 emits beta rays or X-rays, and those rays which penetrate through the filler of the cigarette rod 11*b* impinge upon the signal generating receiver 54 which transmits signals to the correcting or modifying circuits 37 and 44. Of course, if the radiation source 42 of the monitoring device 41 emits beta rays or X-rays, the signal modifying or correcting circuit 44 can be dispensed with.

The output of the signal modifying or correcting circuit 44 transmits corrected signals to the signal comparing circuit 46 which is further connected with a source 47 of reference signals denoting the desired mass flow of fibers in the filler 11*a*. When the actual mass flow of fibers in the filler 11*a* (as determined by the monitoring device 41) deviates from the mass flow as denoted by the reference signal which is supplied by the source 47, the output of the circuit 46 transmits signals via conductors 48 and 52. The conductor 52 transmits signals to the reversible drive 34 for the diaphragm 32, and the conductor 48 transmits signals to a reversible motor 49 which constitutes a means for varying the distance of the plane 14 of the trimming discs 13 from the lower reach of the conveyor 6. The directions in which the motor 49 can move the trimming discs 13 of the surplus removing means 12 are indicated by a double-headed arrow 51. The purpose of the motor 49 is to compensate for long-range deviations of the average weight of the filler 11*a* from an optimum value as denoted by reference signals from the source 47.

The purpose of the drive means 34 and its connection (by conductor 52) to the output of the signal comparing circuit 46 is to ensure that the monitoring device 26 monitors the mass flow of fibers in that portion of the stream 11 which is to be converted into the filler 11*a*, i.e., the mass flow of fibers in that portion of the stream 11 which can bypass the trimming discs 13 and does not form part of the removed surplus 16.

The monitoring device 41 is optional because its function can also be performed by the monitoring device 38. It will be noted that each of these monitoring devices is located downstream of the surplus removing station S. The monitoring device 41 is located upstream, and the monitoring device 38 is located downstream, of the location (wrapping mechanism 17) where successive increments of the filler 11*a* and web 9 are converted into successive increments of the cigarette rod 11*b*. It is also possible to employ a monitoring device 38 which has a radiation source 53 for emission of light, especially infrared light. The utilization of a monitoring device 38 with a source of beta rays or X-rays is preferred at this time because such monitoring device is not affected by the blend and/or color of fibers 1 in successive increments of the filler of the cigarette rod 11*b*.

If the monitoring device 41 is omitted, the output of the signal generating means 54 of the monitoring device 38 is connected directly to an input of the signal comparing circuit 46. This is indicted in FIG. 1 by a broken-line conductor 56. Thus, omission of the monitoring device 41 renders it possible to omit the modifying or correcting circuit 44.

Monitoring devices corresponding to the monitoring device 38 of FIG. 1 are distributed by the assignee of the present application and are known as NSR. Such monitoring devices operate with beta rays. Monitoring devices which operate with X-rays and with light are disclosed, for example, in published British patent applications Nos. 2 133 965 and 2 179 444.

The monitoring devices 26 and 41 can also operate with beta rays or capacitively. All that counts is to ensure that the selected monitoring devices can properly ascertain the mass flow of fibers 1 in successive increments of the stream 11 and filler 11*a*. However, a monitoring device 26 which operates with infrared light is preferred at this time because of its ability to bring about practically immediate changes of the level of the lower reach of the conveyor 6 when the monitored mass flow of fibers 1 in the untrimmed stream 11 deviates from the desired range of mass flows.

The monitoring device 38 can constitute any one of presently known and utilized monitoring devices which are capable of ascertaining the mass flow of fibers in a cigarette rod, filter rod or in any other body wherein the fibrous material is confined in a tubular envelope of cigarette paper, artificial cork or other wrapping material of the type customarily employed in the tobacco processing industry.

Figure 3:
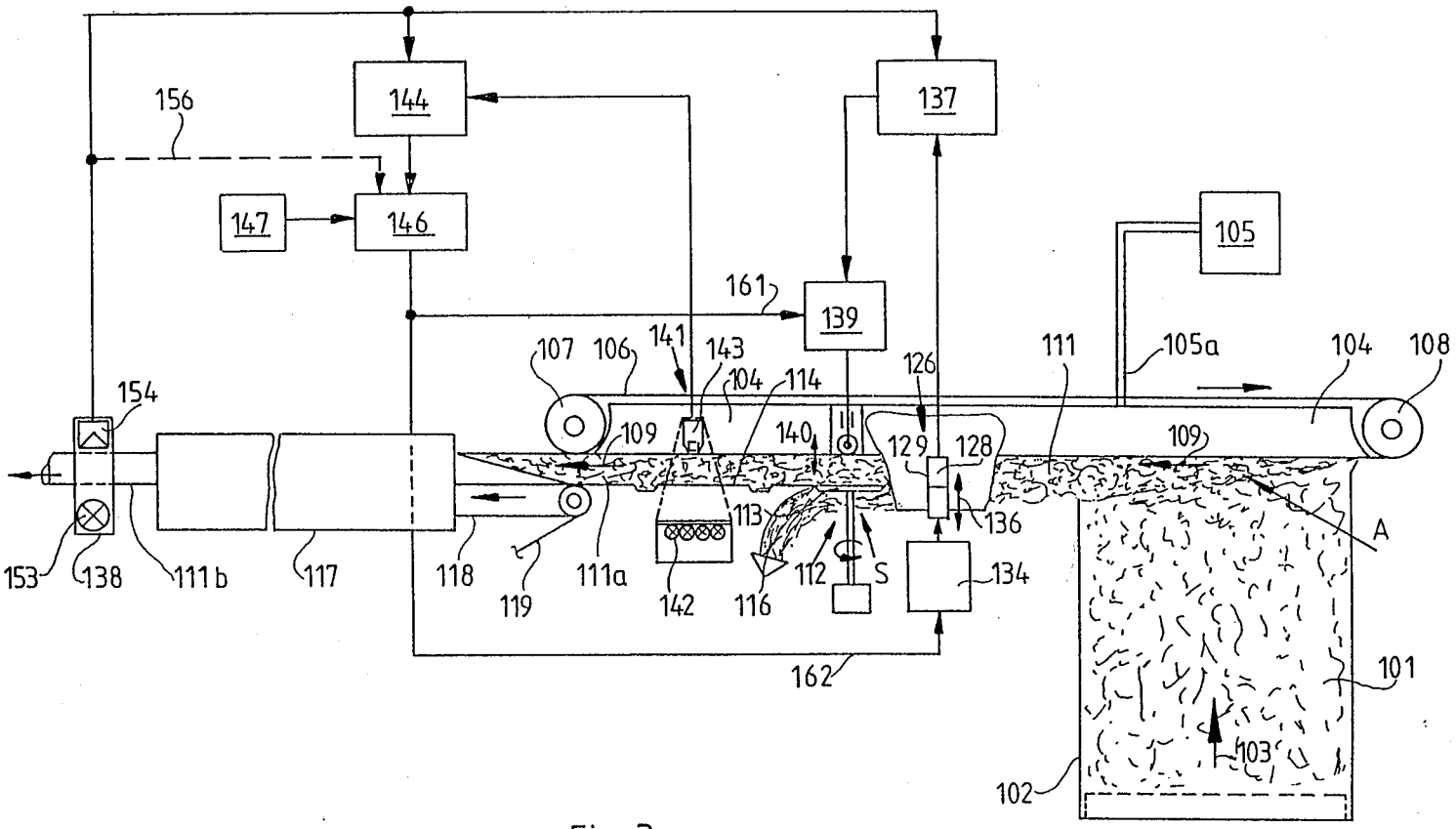
FIG. 3 is a view similar to that of FIG. 1 but showing a modified apparatus with a conveyor which is movable toward and away from a fixedly mounted trimming device.

FIG. 3 illustrates a portion of a cigarette rod making machine which embodies a modified apparatus. All such parts of the machine and apparatus of FIG. 3 which are identical with or clearly analogous to the corresponding parts of the machine and apparatus of FIG. 1 are denoted by similar reference characters plus 100. The main difference between the apparatus of FIGS. 1 and 3 is that the surplus removing means 112 of FIG. 3 is fixedly mounted in the frame of the cigarette rod making machine, i.e., the level of the surplus removal plane 114 remains unchanged. This is desirable and advantageous because it enhances the quality of the trimmed surface at the underside of the filler 111*a*.

The manner in which the monitoring device 126 initiates rapid changes of the level of the lower reach of the conveyor 106 in immediate response to generation of signals denoting an unsatisfactory mass flow of fibers 101 in successive increments of the stream 111 is the same as described in connection with FIG. 1. The signal from the output of the signal comparing circuit 146 is transmitted to an input of the moving means 139 by way of a conductor 161. The purpose of signals from the output of the signal comparing circuit 146 is to induce the moving means 139 to adjust the level of the lower reach of the conveyor 106 for the purpose of compensating for long-range deviations of the mass flow of fibers 101 in the stream 111 from the desired range or value. Thus, the level of the lower reach of the conveyor 106 can be changed in response to signals from the monitoring device 126 as well as in response to signals from the monitoring device 138 and/or 141. This is in contrast to operation of the embodiment of FIG. 1 wherein the level of the lower reach of the conveyor 6 is changed only in response to signals from the monitoring device 26 whereas the signals from monitoring devices 38 and 41 influence the level of the plane 14 of trimming discs 13. The moving means 139 has an electronic component which preferably receives signals from the output of the signal comparing circuit 146 by way of the conductor 161. The output of the signal comparing circuit 146 is further connected with the reversible drive 134 for the diaphragm (not specifically shown in FIG. 3) in the monitoring device 126 by way of conductor means 162 so that the level of the diaphragm can be changed in directions which are indicated by a double-headed arrow 136 in a manner and for the purposes as already described in connection with FIG. 2. FIG. 3 merely shows one of the windows 128 in the tobacco channel and the receiver 129 of the monitoring device 126. The purpose of vertical adjustment of the diaphragm in the monitoring device 126 is to ensure that the receiver 129 will transmit to the signal correcting or modifying circuit 137 only those signals which are indicative of the mass flow of fibers 101 in the upper portion of the stream 111, namely in that portion which is to constitute the filler 111*a*.

FIG. 4 shows the details of the moving means 39 or 139 which serves to change the position or level of the lower reach of the conveyor 6 or 106 relative to the trimming plane 14 or 114. The upper side of the lower reach of the conveyor 6 or 106 contacts the lowermost portions of a row of rollers 66*a*, 66*b*, 66*c*, 66*d*, 66*e*. Such rollers can be driven, they can constitute idler rollers, or each of these rollers can be non-rotatably mounted in the suction chamber 4 or 104. The median roller 66*c* is shown in its lower end position and is disposed at the upstream end of the surplus removing station S. Such roller is mounted at the lower end of a link 68 which is guided for vertical reciprocatory movement relative to the suction chamber 4 or 104 in directions which are indicated by an arrow 40, 140 (depending upon whether the roller 66*c* is used in the apparatus of FIG. 1 or 3). The upper end portion of the link 68 is articulately connected to a link on the output element of a reversible stepping motor 67 which constitutes a component part of the moving means 39 or 139 and receives signals from a signal applying means 69. Such signal applying means is connected only to the signal correcting or modifying means 37 or to the signal modifying or correcting means 137 and to the output of the signal comparing circuit 146 of FIG. 3. The signal applying means 69 is connected only to the signal correcting or modifying means 37 if the motor 67 is installed in the apparatus of FIG. 1. However if such motor is used in the apparatus of FIG. 3, i.e., if it forms part of the moving means 139, the signal applying means 69 receives signals from the circuits 137 and 146 because the lower reach of the conveyor 106 must be shifted toward or away from the plane 114 of the surplus removing discs 113 not only in order to compensate for short-range deviations but also to compensate for long-range deviations of the mass flow of fibers 101 in the stream 111.

If the mass flow of fibers between the conveyor 6 or 106 on the one hand and the trimming plane 14 or 114 on the other hand is to be reduced, the stepping motor 67 receives from the signal applying means 69 one or more signals which cause the motor 67 to lower the link 68 (i.e., the output element of the stepping motor 67 is driven in a counterclockwise direction through one or more steps) whereby the roller 66*c* pushes the adjacent portion of the conveyor 6 or 106 downwardly toward the plane 14 or 114 and the cross sectional area of the path portion which permits fibers 1 or 101 to bypass the surplus removing means 12 or 112 is reduced. If the quantity of tobacco fibers 1 or 101 in the filler 11*a* or 111*a* is to be increased, the signal applying means 69 transmits to the stepping motor 67 one or more signals which cause the motor to move the link 68 and the roller 66*c* upwardly whereby suction in the chamber 4 or 104 attracts the stream 11 or 111 because the air flows through the stream and into the suction chamber in the direction which is indicated by arrows 71. Consequently, the stream 11 or 111 rises with the lifted portion of the conveyor 6 or 106 and a larger quantity of fibers 1 or 101 is permitted to advance above the trimming plane 14 or 114.

It has been found that the moving means 39 or 139 of FIG. 4 is capable of reacting practically instantaneously to signals from the monitoring device 26 or 126 so as to alter the rate of advancement of tobacco fibers 1 or 101 above the trimming plane 14 or 114. In other words, the moving means 39 or 139 can influence, practically instantaneously, the mass flow of fibers 1 or 101 in successive increments of the filler 11*a* or 111*a*. The advantages are even more pronounced if the monitoring device 26 or 126 employs one or more sources of infrared light because this enables the device 26 or 126 to generate signals in immediate response to any changes of the mass flow of fibers 1 or 101 in the stream 11 or 111.

As mentioned above, an important advantage of the improved apparatus is that it can react, practically instantaneously, to any deviations of the mass flow of fibers in the interesting or important portion of the stream 11 or 111 from the optimum value or optimum range of values. This holds especially true if the monitoring device 26 or 126 employs one or more sources of infrared light.

Another important advantage of the improved apparatus is that the windows 28 or 128 and the associated diaphragm (such as the diaphragm 32 of FIG. 2) render it possible to monitor the mass flow of fibers 1 or 101 only in that portion of the stream 11 or 111 which is to be converted into the filler 11*a* or 111*a*, i.e., which is not to be removed from the stream 11 or 111 in the form of a surplus 16 or 116. Such mode of monitoring the mass flow of fibers 1 or 101 in a portion only of the stream 11 or 111 contributes to the accuracy and reliability of the results of measurement.

An additional important advantage of the improved apparatus is that it is not always necessary (or is not necessary at all) to change the level of the trimming plane 14 or 114 because the lower reach of the conveyor 6 or 106 is movable up and down, when necessary, so as to ensure that the mass flow of fibers 1 or 101 in the filler 11*a* or 111*a* will equal or closely approach the desired optimum value. As explained above, the trimming discs 13 in the apparatus of FIG. 1 will be moved up or down only in order to compensate for long-range deviations of the mass flow from the desired value. On the other hand, the trimming discs 113 of the surplus removing means 112 in the apparatus of FIG. 3 can remain at a fixed level because the lower reach of the conveyor 106 is movable up and down in response to signals from the monitoring device 126 as well as in response to signals from the monitoring device 138 and/or 141.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of treating accumulations of fibers of tobacco, other smokable material or filter material for tobacco smoke, comprising the steps of establishing for the fibers an elongated path; supplying fibers into a first portion of the path in such quantities that the fibers form a stream which contains a surplus of fibers; advancing the stream along said path in a predetermined direction by a foraminous conveyor, including attracting the fibers to the conveyor by suction; removing the surplus from the stream in a second portion downstream of the first portion of the path to thus convert the stream into a filler, including trimming the stream in a plane which is spaced apart from the conveyor; monitoring the mass flow of fibers in the path upstream of the second portion of the path and generating a succession of signals denoting the mass flow of fibers in successive increments of the stream; and moving the conveyor relative to the plane in response to said signals so as to maintain the mass flow of fibers in the filler within a predetermined range.

2. The method of claim 1, wherein said moving step includes moving the conveyor nearer to the plane when the mass flow exceeds said range and moving the conveyor away from the plane when the mass flow is beneath said range.

3. The method of claim 1, wherein said monitoring step includes directing against the stream at least one beam of radiation a portion of which penetrates through the stream and is indicative of the mass flow of fibers in the respective increments of the stream, said signals being indicative of the radiation which penetrates through the stream.

4. The method of claim 3, wherein said radiation is infrared light.

5. The method of claim 3, wherein said radiation consists of X-rays.

6. The method of claim 1, wherein said monitoring step includes monitoring the mass flow of those fibers which are disposed between the conveyor and the plane.

7. The method of claim 1, further comprising the step of monitoring the mass flow of fibers in successive increments of the filler in a third portion downstream of the second portion of said path and generating a succession of second signals denoting such mass flow.

8. The method of claim 7, further comprising the step of draping the filler into a web of wrapping material in a fourth portion of said path downstream of said third portion.

9. The method of claim 8, wherein said step of monitoring the mass flow of fibers in successive increments of the filler includes directing against the filler at least one beam of light whereby some of the light penetrates through the filler, said second signals being indicative of light which penetrates through the filler.

10. The method of claim 9, wherein said light is infrared light.

11. The method of claim 8, wherein said step of monitoring the mass flow of fibers in successive portions of the filler includes directing against the filler at least one beam of X-rays whereby some rays penetrate through the filler, said second signals being indicative of rays which penetrate through the filler.

12. The method of claim 7, further comprising the step of draping the filler into a web of wrapping material in a fourth portion of the path upstream of said third portion.

13. The method of claim 12, wherein said step of monitoring the mass flow of fibers in successive increments of the filler includes directing against the filler at least one beam of light whereby some of the light penetrates through the filler, said second signals being indicative of light which penetrates through the filler.

14. The method of claim 13, wherein said light is infrared light.

15. The method of claim 12, wherein said step of monitoring the mass flow of fibers in successive increments of the filler includes directing against the filler at lest one beam of beta rays whereby at least some beta rays penetrate through the filler, said second signals being indicative of beta rays which penetrate through the filler.

16. The method of claim 12, wherein said step of monitoring the mass flow of fibers in successive increments of the filler includes directing against the filler at least one beam of X-rays whereby at least some X-rays penetrate through the filler, said second signals being indicative of X-rays which penetrate through the filler.

17. The method of claim 1, wherein said monitoring step comprises directing against the stream at least one beam of light a portion of which penetrates through the stream and is indicative of the mass flow of fibers in the respective increments of the stream, said signals being indicative of light which penetrates through the stream, and further comprising the step of monitoring the mass flow of fibers in a further portion of said path including directing against the fibers in said further portion at least one beam of beta rays some of which penetrate through the fibers in said further portion of the path and are indicative of the mass flow of fibers in the further portion of aid path, and generating second signals which are indicative of beta rays that penetrate through the fibers, and further comprising the step of modifying the signals which denote light that penetrates through the stream with said second signals.

18. The method of claim 1, wherein said monitoring step comprises directing against the stream at least one beam of light a portion of which penetrates through the stream and is indicative of the mass flow of fibers in the respective increments of the stream, said signals being indicative of light which penetrates through the stream, and further comprising the step of monitoring the mass flow of fibers in a further portion of said path including directing against the fibers in said further portion at least one beam of X-rays some of which penetrate through the fibers in said further portion of the path and are indicative of the mass flow of fibers in the further portion of said path, and generating second signals which are indicative of X-rays that penetrate through the fibers, and further comprising the step of modifying the signals which denote light that penetrates through the stream with said second signals.

19. The method of claim 1, further comprising the steps of monitoring the mass flow of fibers in a further portion of said path and generating second signals denoting the monitored mass flow of fibers in said further portion, and varying the mutual spacing of the conveyor and the plane as a function of the characteristics of said second signals so as to maintain the mass flow of fibers in the filler at a preselected average value.

20. The method of claim 19, wherein said varying step includes moving the conveyor relative to the plane.

21. The method of claim 19, wherein said varying step includes moving the plane relative to the conveyor.

22. Apparatus for treating accumulations of fibers of tobacco or other smokable material or filter material for tobacco smoke, comprising guide means including a foraminous conveyor defining an elongated path; means for supplying fibers into a first portion of the path in such quantities that the fibers form a stream which contains a surplus of fibers; means for pneumatically attracting the fibers to said conveyor so that the stream advances with the conveyor along said path in a predetermined direction; means for removing the surplus from the stream in a second portion downstream of the first portion of the path to thus connect the stream into a filler, including means for trimming the stream in a plane which is spaced apart from the conveyor; means for monitoring the mass flow of fiber in the path upstream of the second portion of the path, including means for generating a succession of signals denoting the mass flow of fibers in successive increments of the stream; and means for moving at least a portion of the conveyor relative to said plane in response to said signals.

23. The apparatus of claim 22, wherein said monitoring means further includes at least one source of radiation arranged to direct against the stream at least one beam of radiation a portion of which penetrates through the stream and is indicative of the mass flow of fibers in the respective increments of the stream, said signal generating means including at least one receiver of radiation which penetrates through the stream.

24. The apparatus of claim 23, wherein said at least one source emits light.

25. The apparatus of claim 24, wherein said light is infrared light.

26. The apparatus of claim 23, wherein said at least one source emits X-rays.

27. The apparatus of claim 22, wherein said guide means includes an elongated channel having sidewalls and a bottom wall constituted by said conveyor, said monitoring means including means for monitoring the mass flow of fibers in said channel between said conveyor and said plane.

28. The apparatus of claim 27, wherein said conveyor includes an endless foraminous belt conveyor.

29. The apparatus of claim 22, further comprising second monitoring means for monitoring the mass flow of fibers in the path downstream of said second portion of the path, including means for generating second signals denoting the mass flow of fibers in successive increments of the filler 30. The apparatus of claim 29, further comprising means for draping the filler into a web of wrapping material downstream of said second monitoring means.

31. The apparatus of claim 29, further comprising means for draping the filler into a web of wrapping material upstream of said second monitoring means.

32. The apparatus of claim 29, wherein said second monitoring means further includes at least one source of radiation arranged to direct against the filler at least one beam of radiation a portion of which penetrates through the filler and is indicative of the mass flow of fibers in the respective increments of the filler, said means for generating second signals including at least one receiver of radiation which penetrates through the filler.

33. The apparatus of claim 32, wherein said source emits light.

34. The apparatus of claim 33, wherein said source emits infrared light.

35. The apparatus of claim 32, wherein said source emits X-rays.

36. The apparatus of claim 32, wherein said source emits beta rays.

37. The apparatus of claim 22, further comprising means for modifying said signals.

38. The apparatus of claim 37, wherein said monitoring means further includes at least one light source arranged to direct against the stream at least one beam of light a portion of which penetrates through the stream and is indicative of the mass flow of fibers in the respective increments of the stream, said signal generating means including at least one receiver of light which penetrates through the stream.

39. The apparatus of claim 38, wherein said source emits infrared light.

40. The apparatus of claim 22, further comprising second monitoring means for monitoring the mass flow of fibers in the path downstream of said second portion of said path, including means for generating second signals denoting the mass flow of fibers in successive increments of the filler, and means for varying the distance between said conveyor and said plane in response to said second signals so as to maintain the mass flow of fibers in the filler at least close to a predetermined value.

41. The apparatus of claim 40, wherein said varying means includes means for moving said trimming means nearer to and away from said conveyor.

42. The apparatus of claim 40, wherein said varying means includes means for changing the position of said conveyor relative to said trimming means.

43. The apparatus of claim 42, wherein said means for changing the position of said conveyor comprises a stepping motor.

44. The apparatus of claim 43, wherein said varying means further comprises means for modifying signals denoting the mass flow of fibers in successive increments of the stream by said second signals and means for applying the modified signals to said motor.

45. The apparatus of claim 44, wherein said varying means further comprises means for comparing said second signals with a reference signal denoting a desired mass flow of fibers in the filler and for generating additional signals denoting the difference between the second signals and said reference signal, said applying means being operative to regulate the operation of said motor in response to said additional signals.

* * * * *